US007042480B2

(12) United States Patent
Ito

(10) Patent No.: US 7,042,480 B2
(45) Date of Patent: May 9, 2006

(54) THERMAL PRINTER

(75) Inventor: Akihiko Ito, Chiba (JP)

(73) Assignee: Seiko Instruments Inc., Chiba (JP)

( * ) Notice: Subject to any disclaimer, the term of this patent is extended or adjusted under 35 U.S.C. 154(b) by 65 days.

(21) Appl. No.: 10/659,507

(22) Filed: Sep. 10, 2003

(65) Prior Publication Data

US 2004/0080604 A1 Apr. 29, 2004

(30) Foreign Application Priority Data

Sep. 27, 2002 (JP) ..... 2002283230

(51) Int. Cl.
*B41J 11/00* (2006.01)

(52) U.S. Cl. ..... 347/220

(58) Field of Classification Search ..... 347/220, 347/197, 198, 222; 400/691, 692, 693, 120.16, 400/120.07, 648, 649
See application file for complete search history.

(56) References Cited

U.S. PATENT DOCUMENTS 5,366,302 A * 11/1994 Masumura et al. .... 400/120.16
5,386,772 A 2/1995 Tolle et al.
5,847,742 A 12/1998 Nishimura
6,249,302 B1 * 6/2001 Sekiya ..... 347/220
6,450,714 B1 * 9/2002 Mori et al. ..... 400/649
6,567,113 B1 * 5/2003 Louis ..... 347/222
6,765,602 B1 * 7/2004 Mori ..... 347/220

FOREIGN PATENT DOCUMENTS

EP 1 036 662 A2 9/2000

* cited by examiner

*Primary Examiner*—K. Feggins
(74) *Attorney, Agent, or Firm*—Adams & Wilks

(57) ABSTRACT

A thermal printer has an outer frame that rotatably supports a platen roller. An inner frame is detachably attachable to the outer frame and has assembled thereon a head support body, a thermal head supported by the head support body, and biasing springs for urging the head support body toward the platen roller to apply a pressing force between the thermal head and the platen roller. During a printing operation, heating elements of the thermal head are energized to perform printing on a paper sandwiched between the thermal head and the platen roller. The inner frame together with the head support body, the thermal head and the biasing springs are detachable as an assembled unit from the outer frame. This enables easy maintenance of the thermal printer, such as replacement of the thermal head, and shortening of the time for maintenance and a reduction in maintenance cost.

2 Claims, 6 Drawing Sheets

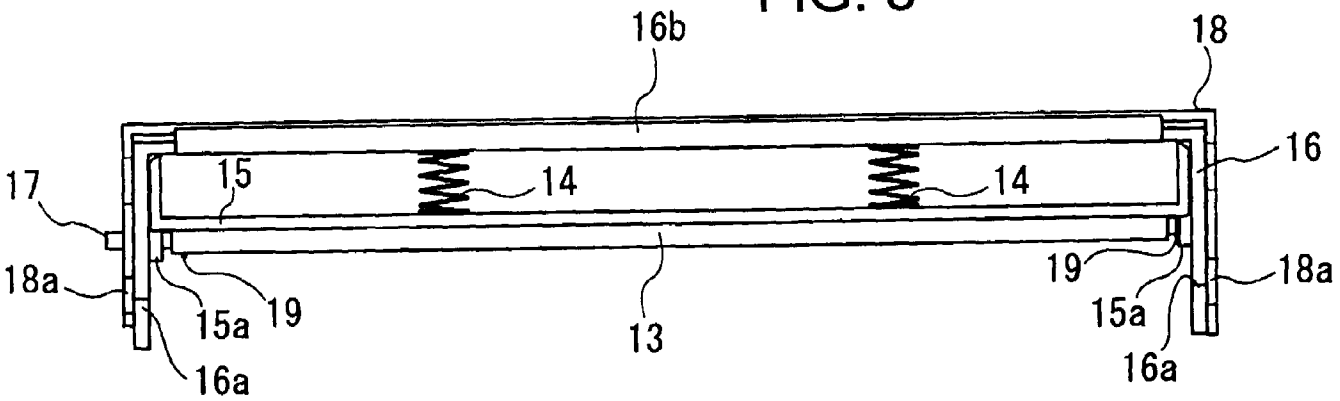
FIG. 3
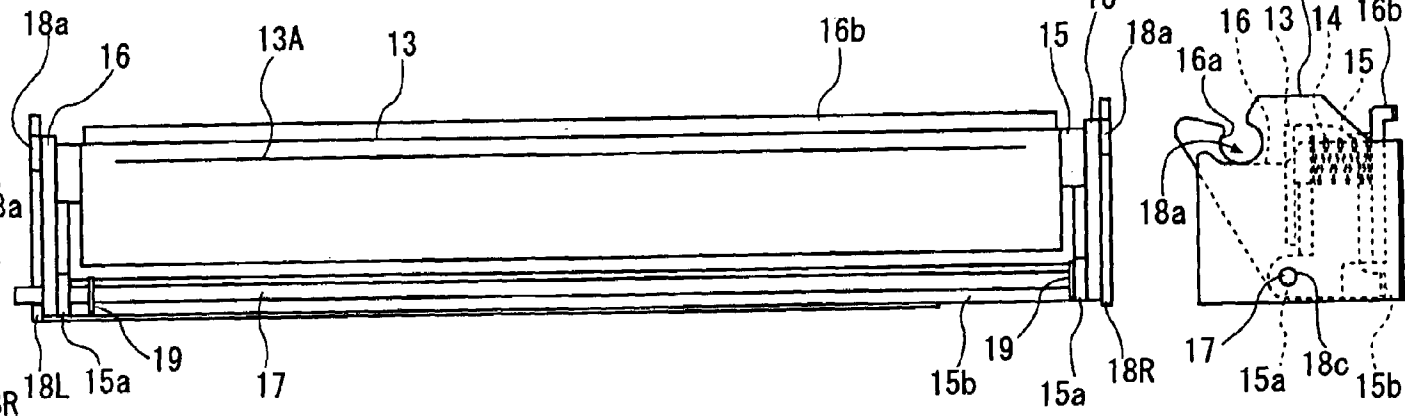
FIG. 4C
FIG. 4A
FIG. 4B

THERMAL PRINTER

BACKGROUND OF THE INVENTION

1. Field of the Invention

The present invention relates to a thermal printer in which printing is performed while paper is sandwiched between a thermal head and a platen roller, and more particularly to a technique usefully utilized in a printer in which bar-code printing is performed, for example.

2. Description of the Related Art

Thermal printers, in which printing is performed by pressing thermal recording paper between a thermal head having a heating element and a platen roller, are often applied to, for example, a printer for performing receipt-printing in a cash register and a portable label printer for performing printing of POS labels for foods and labels for distribution management.

A conventional thermal printer is structured such that a thermal head is fixed to a head support body that also serves as a heat radiating plate; the head support body is rotatably supported with a shaft by means of a frame or the like of the printer; and further, the head support body is biased by a spring or the like to be pressed against a platen roller side (for example, refer to JP 04-140175 A).

In the conventional thermal printer, in the case where failure is caused in printing dots of a thermal head due to the influence of, for example, over electrification and damage on paper, there is no way but to disassemble the whole printer and exchange the thermal head. Such work has been extremely troublesome.

In particular, in the conventional thermal printer, a metal fitting with an E-shape which is so called E-ring is fastened to a shaft with which a head support body is axially supported by a frame such that the shaft is not slid horizontally; alternatively, a support shaft, which is provided to be projected from right and left side surfaces of the head support body, is press-fitted in a bearing provided in the frame to be fixed. That is, the conventional thermal printer has a structure in which a thermal head cannot be disassembled easily. It has been impossible that only the thermal head portion is removed while the thermal printer is being incorporated in a main body apparatus.

Generally, a thermal printer that performs printing of characters and the like does not particularly require an exchange of a thermal head when at least printing failure with one dot occurs. However, in recent years, a label printer that performs label printing for distribution management may involve bar-code printing. There is a fear that a problem develops even with a little dot chip when the bar-code printing will be performed with fine lines in the future. Therefore, it is considered that how frequently the exchange of the thermal head due to wrong dots or the like is increased more than before.

SUMMARY OF THE INVENTION

The present invention has been made in view of the above, and therefore has an object to provide a thermal printer which enables easy maintenance such as an exchange of a thermal head to attain shortening of time for the maintenance and reduction in maintenance cost.

According to the present invention, in order to achieve the above object, in a thermal printer in which printing is performed while paper is sandwiched between a thermal head having a heating element and a platen roller, the thermal printer is provided with a head support body to which the thermal head is fixed; a first frame that movably holds the head support body; biasing means that is formed between the head support body and the first frame and generates a pressing force between the thermal head and the platen roller; and a second frame that holds the first frame and the platen roller, wherein the thermal head, the head support body, and the biasing means are detachably attachable as a unit to the second frame in the state of being assembled with the first frame.

The thermal head is biased by the biasing means such as a spring in order to obtain the pressing force with the platen roller, and a relatively large force is applied between the component that supports the thermal head and the component that supports one end of the biasing means. Thus, those components are difficult to be easily made detachably attachable. Therefore, according to the present invention, the two frames, the first frame that supports the end of the biasing means and further holds the head support body and the second frame that holds the other components are used, and are made detachably attachable. As a result, the thermal head portion can be easily removed from the printer main body.

Further, printing failure of the thermal head may arise from the strength of the pressing force between the thermal head and the platen roller. Thus, it is preferable that a printing test is performed while the biasing means that generates the pressing force is kept in its original state in the case where the printing test is performed with the thermal head being removed. According to the present invention, the thermal head can be removed while the biasing means is kept in the original state. Thus, there can be performed the printing test that includes the strength of the pressing force generated by the biasing means. Further, also in the case where a printing test of the thermal head itself is performed, detachment and attachment work of the biasing means is not required. Thus, simplification of the test can be attained.

It is preferable that the second frame is provided with a receiving groove for holding a rotating shaft of the platen roller; and the first frame has a hook portion that is hooked around a component held in the receiving groove, and also serves as lock means that locks the platen roller to prevent it from being released from the receiving groove.

With the above-mentioned structure, the reduction in the number of components can be attained after both the function of locking/releasing the platen roller and the function of enabling easy attachment and detachment of the thermal head are provided.

It is more preferable that attachment and detachment of the first frame and second frame are made possible through opening and closing of a fixture that enables fixation and release with one operation or through attachment and detachment of a screw. Thus, attachment and detachment of the thermal head portion can be easily performed while the thermal printer is being attached to the main body apparatus.

Specifically, bearing holes through which a support shaft is passed are provided in both side walls of each of the head support body and the first frame; the second frame is provided with a bearing hole, through which the support shaft is passed, in one of side walls thereof, and a bearing groove, which bears the support shaft, in the other side wall; the support shaft is passed through the bearing holes of the first frame and second frame and the bearing hole of the head support body and is borne in the bearing groove of the second frame, whereby the head support body is held by the first frame in a rotatable state about the support shaft, and also, the first frame is held by the second frame in a rotatable state about the support shaft; the support shaft is stopped with a metal fitting that retains the support shaft so as to be prevented from falling out from the head support body and the first frame in a state in which a movable range, in which the support shaft can be slide in an axial direction, is left; the thermal printer is provided with fixing means which is brought into contact with the support shaft in a state in which the support shaft is passed through the bearing hole of the second frame to limit a slide of the support shaft in the movable range and which retains the support shaft to prevent it from being released from the bearing groove of the second frame; the retainment of the fixing means is released to make the support shaft slid in the movable range, whereby the support shaft is made to fall out from the bearing hole of the second frame while the support shaft is passed through the first frame and the head support body to make the first frame removable from the second frame.

Further, it is preferable that the fixing means is comprised of a fixture that enables retainment and release of the support shaft through one operation or attachment and detachment of a screw.

BRIEF DESCRIPTION OF THE DRAWINGS

In the accompanying drawings:

FIGS. 2A and 2B are perspective views showing the printing mechanism portion, in which FIG. 2A shows a state in which all the components are assembled with one another and FIG. 2B shows a state in which a lock frame is removed after a platen roller is removed;

FIG. 3 is a plan view showing the printing mechanism from which the platen roller is removed;

FIGS. 4A to 4C show the printing mechanism from which the platen roller is removed: in which FIG. 4A is a front view; FIG. 4B is a left side view; and FIG. 4C is a right side view;

FIGS. 6A to 6D show the printing mechanism in a state in which the lock frame is removed from an outer frame: in which FIG. 6A is a front view of the outer frame; FIG. 6B is a left side view thereof; FIG. 6C is a front view of the lock frame and the components assembled therewith; and FIG. 6D is a left side view thereof;

DETAILED DESCRIPTION OF THE PREFERRED EMBODIMENT

Hereinafter, an embodiment of the present invention will be described based on the accompanying drawings.

Figure 1:
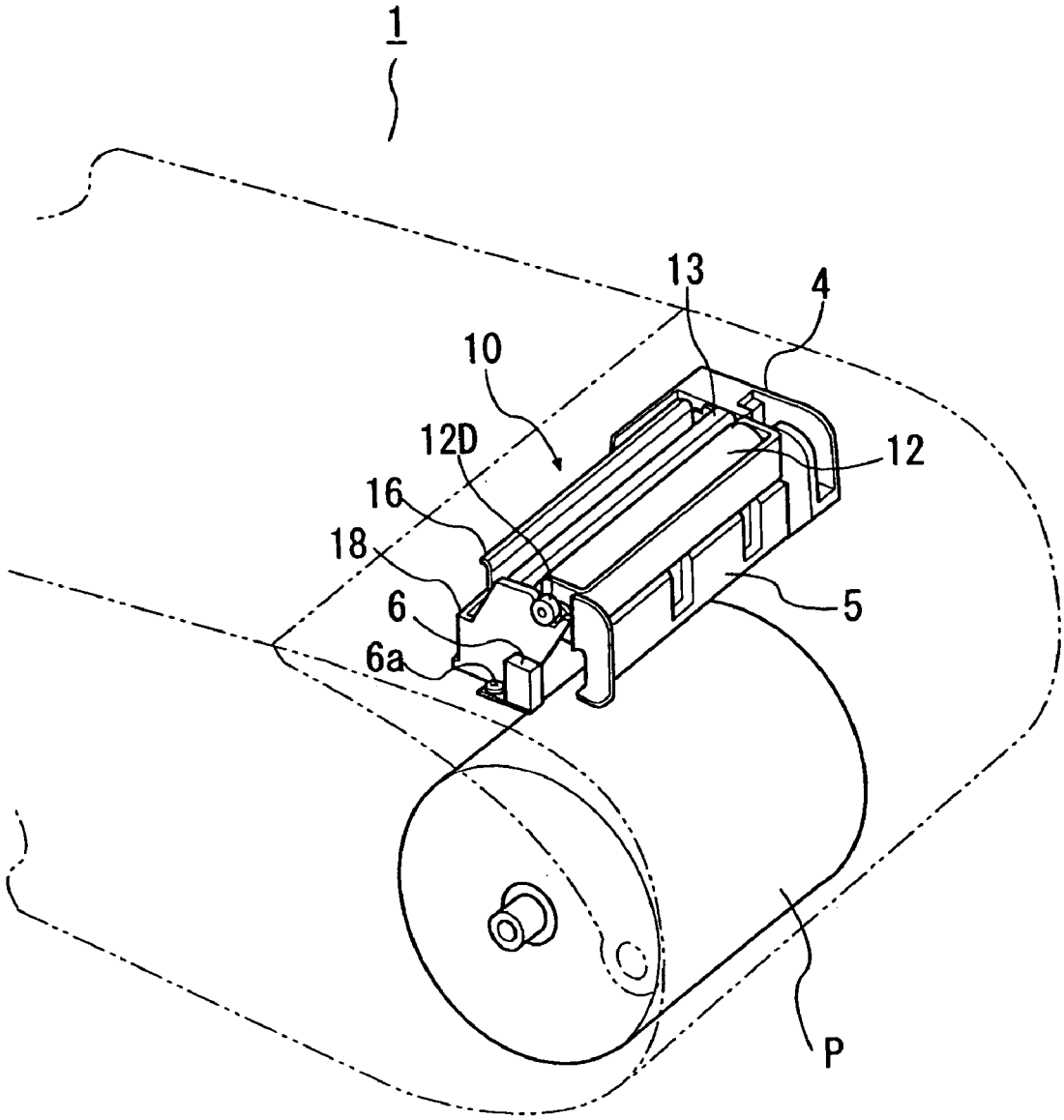
FIG. 1 is a perspective view showing a printing mechanism and a peripheral portion thereof in a label printer in accordance with an embodiment of the present invention.

FIG. 1 is a perspective view showing a printing mechanism and a peripheral portion thereof in a label printer in accordance with the embodiment of the present invention.

A thermal printer in this embodiment is not particularly limited. However, the printer is a portable label printer 1 in which printing is performed on, as paper, a recording sheet P with a sheet of release paper (called label paper) whose back-side adhesion surface is exposed by releasing the sheet of release paper, and is required to perform bar-code printing on a label for distribution management. In the label printer 1, a printing mechanism 10 for performing thermal printing is provided above a roll-paper receiving portion for receiving the recording sheet P.

In FIG. 1, reference numeral 4 denotes a gear box in which a gear for rotating a platen roller 12 is kept; 5 denotes a paper guide that guides paper between the platen roller 12 and a thermal head 13; and 6 denotes a fixture that retains one end of a shaft 17 described below.

Figure 2A:
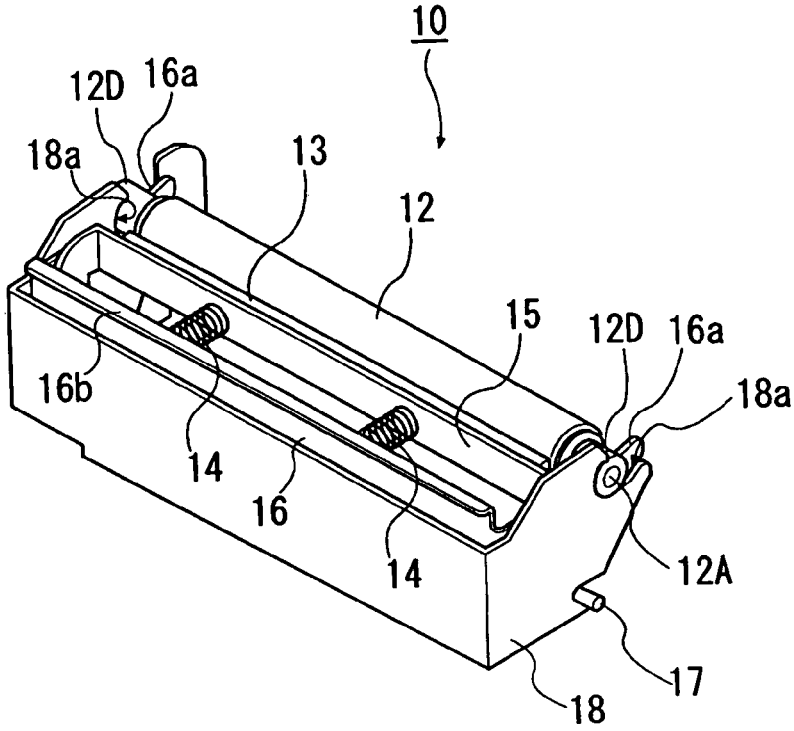
Figure 2B:
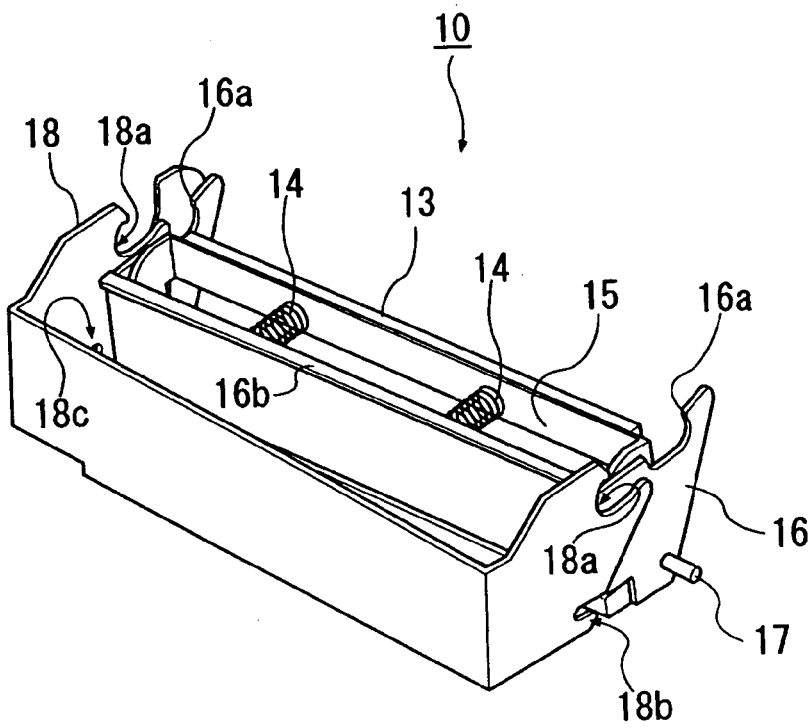

FIGS. 2A and 2B are perspective views showing the printing mechanism 10, where FIG. 2A shows a state in which all the components are assembled with one another and FIG. 2B shows a state in which a lock frame is removed after a platen roller is removed.

As shown in FIG. 1 and FIG. 2A, the printing mechanism 10 is constituted by the thermal head 13 in which a dot row 13A (refer to FIG. 4A) comprised of heating elements is formed on a substrate, the platen roller 12 which makes paper pressed against the portion of the heating elements in the thermal head 13 and which performs paper feeding through its rotation drive, a head support body 15 which supports the thermal head 13 and which exerts heat radiation action to the thermal head 13, a lock or inner frame 16 as a first frame which rotatably holds the head support body 15, springs 14 as biasing means which are provided between the head support body 15 and a rear portion of the lock frame 16 and which bias both the members so as to repel each other, an outer frame 18 that holds all the above components, a shaft (support shaft) 17 that is passed through bearings respectively formed in the head support body 15, the lock frame 16, and the outer frame 18 to rotatably support the respective components, and the like.

The outer frame 18 is provided with receiving grooves 18A that hold bearing members 12D of the platen roller 12. The bearing members 12D rotatably hold a central shaft 12A of the platen roller 12. Further, the lock frame 16 is provided with hook portions 16A that are hooked round the bearing members 12D, held in the receiving grooves 18A and retain the bearing members 12D, 12D to prevent them from falling out from the receiving grooves 18A. The hook portions 16A make the lock frame 16 function as a lock means.

Then, a carrying handle 16B in the rear portion of the lock frame 16 is pushed toward the springs 14, whereby the lock or inner frame 16 is rotated about the shaft 17. Thus, the hook portions 16*a*, 16*a* are separated from the bearing members 12D, which makes the platen roller 12 detachably attachable.

The printing mechanism in this embodiment is structured such that, after the platen roller 12 is removed, the lock or inner frame 16 can be removed from the outer frame 18 without disassembling the thermal head 13, the springs 14, the head support body 15, and the shaft 17. That is, the lock or inner frame 16 together with the thermal head 13, the springs 14, the head support body 15 and the shaft 17 can be detached as an assembled unit from the outer frame 18. Hereinafter, the structure of the above members will be described in detail.

Figure 5:
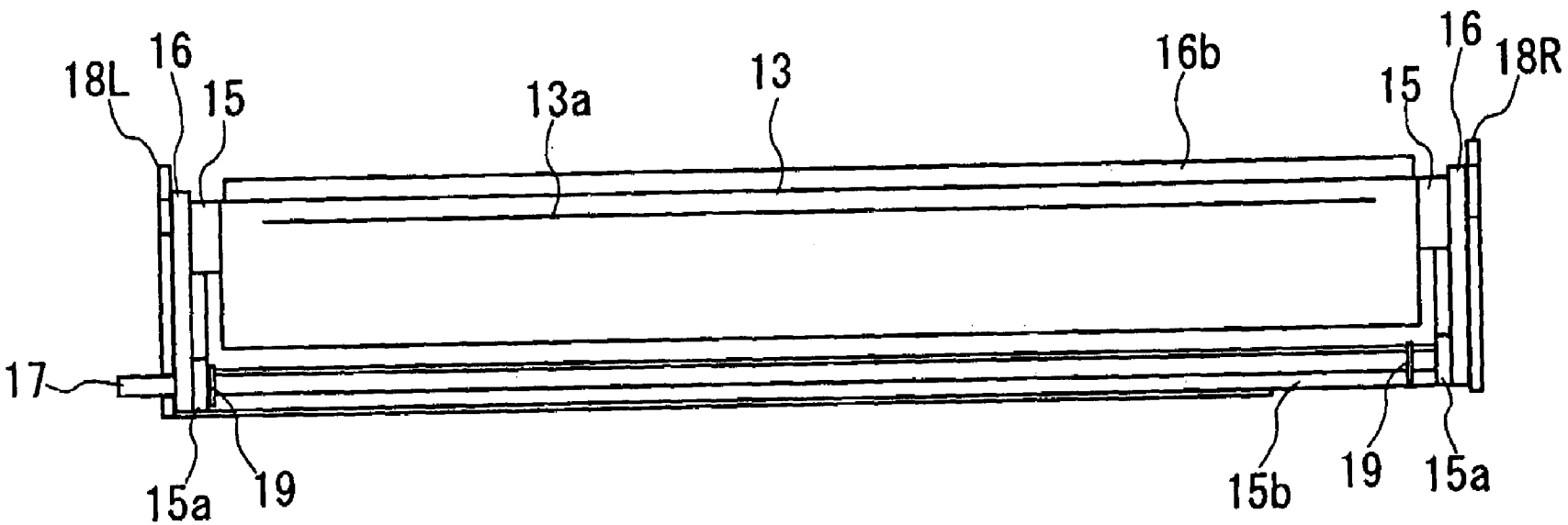
FIG. 5 is a front view showing a state in which a shaft is shifted to a removal position in the printing mechanism in FIGS. 4A to 4C.
Figure 6C:
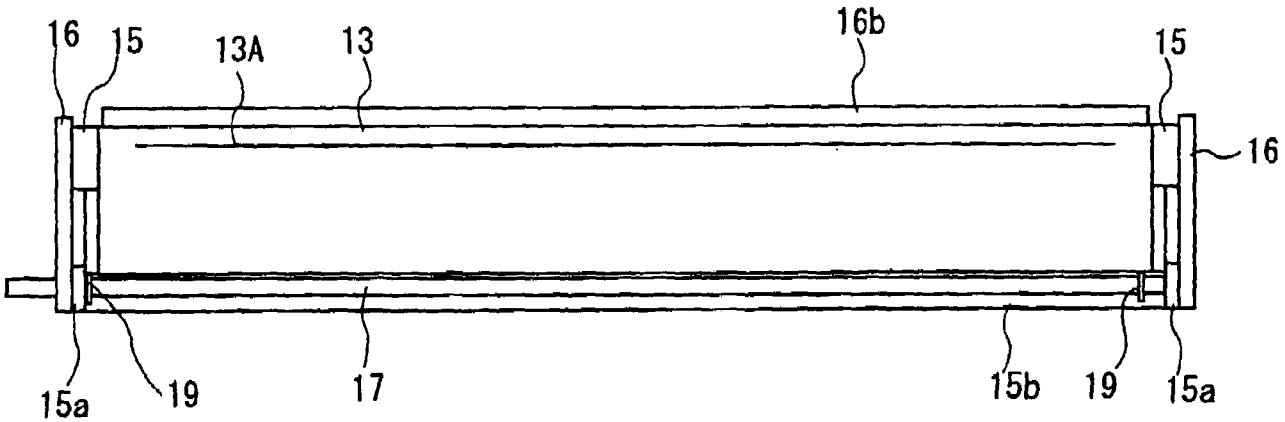
Figure 6A:
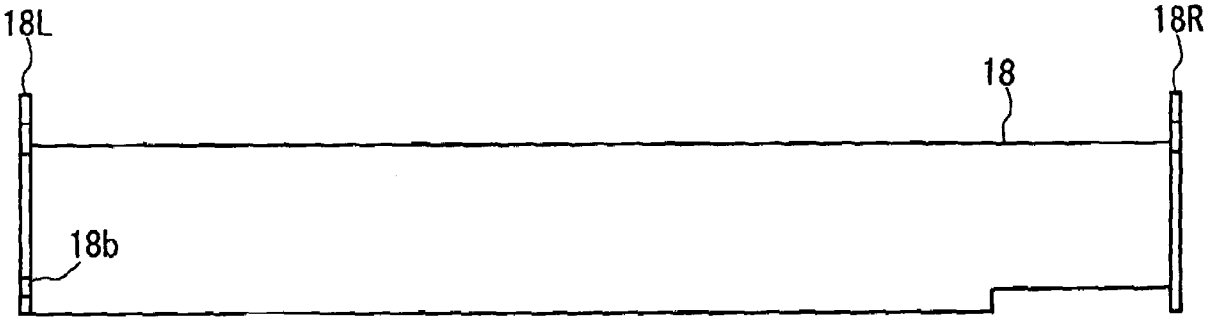
Figure 6D:
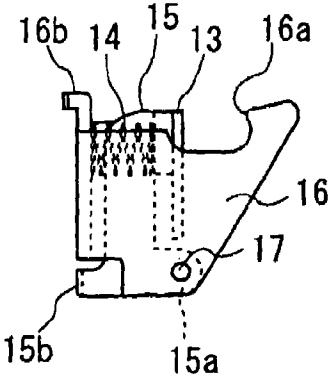
Figure 6B:
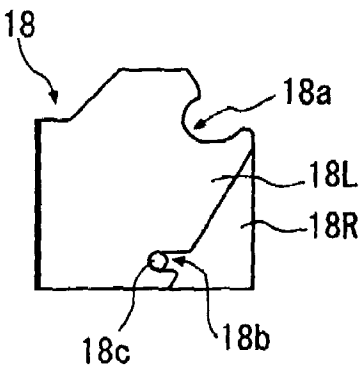

FIG. 3 and FIGS. 4A to 4C show the printing mechanism from which the platen roller has been removed. FIG. 3 is a plan view thereof, FIG. 4A is a front view thereof, FIG. 4B is a left side view thereof, and FIG. 4C is a right side view thereof. Further, FIG. 5 is a front view showing a state in which the shaft in the printing mechanism is shifted to a removal position. FIGS. 6A to 6D show the printing mechanism in a state in which the lock frame is removed from the outer frame. FIG. 6A is a front view of the outer frame, FIG. 6B is a left side view thereof, FIG. 6C is a front view of the lock frame and the components assembled therewith, and FIG. 6D is a left side view thereof. Further, FIG. 7 is an exploded perspective view of the portion that can be removed integrally with the lock frame.

Figure 7:
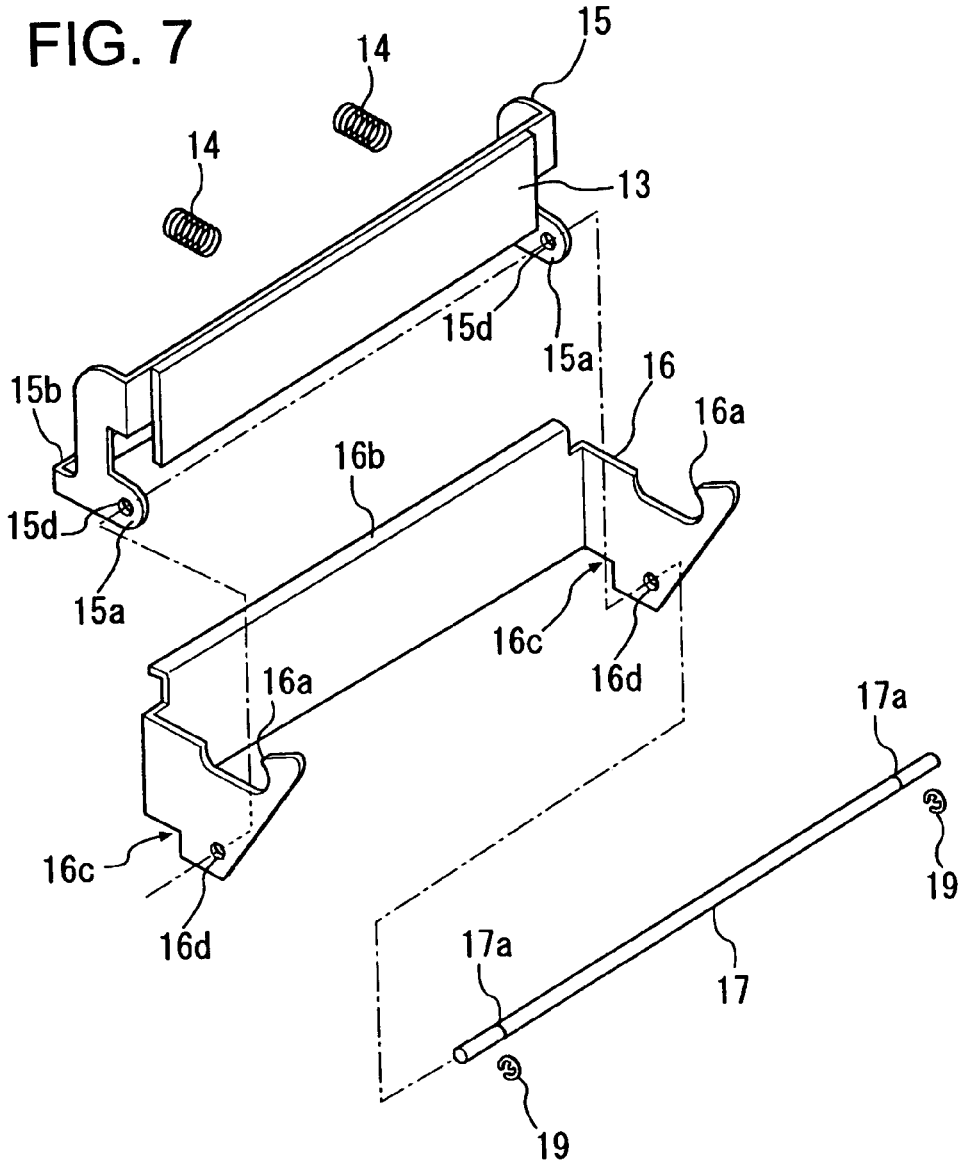
FIG. 7 is an exploded perspective view of a portion that can be removed integrally with the lock frame.

As shown in FIG. 7, as to the head support body 15, the thermal head 13 is adhered to a front surface portion thereof, and right and left side wall portions thereof are provided with flange portions 15A that are projected forward. The flange portions 15A are formed with shaft holes 15D through which the shaft 17 is passed. Further, a projected portion 15B that is projected backward is provided on the lower side of a back portion of the head support body 15.

The lock frame 16 is provided with shaft holes 16D, through which the shaft 17 is passed, in right and left side wall portions thereof, besides the hook portions 16A that retain the bearing members 12D of the platen roller 12 and the rear carrying handle 16B. Further, a notch 16C, which guides a projected portion 15B in the head support body 15 with clearance, is provided in a lower-side rear portion of the lock frame 16.

As to the outer frame 18, as shown in FIGS. 6A and 6B, receiving grooves. 18A which hold the bearing member 12D of the platen roller 12, are provided in left and right side wall portions 18L, 18R. In addition, a bearing hole 18*c* through which the shaft 17 is passed and a U-groove 18*b* as a bearing groove that receives the shaft 17 are provided in the right and left side wall portions 18R, 18L, respectively.

As shown in FIGS. 6C and 6D and FIG. 7, the shaft 17 is passed through the bearing holes 15D, 16D (FIG. 7) which are provided in the respective right and left side wall portions of the head support body 15 and the lock frame 16. Also, fittings (for example, E-rings) 19 are fastened to stop grooves 17A of the shaft 17 inside both the side wall portions of the head support body 15. Thus, the head support body 15, the lock frame 16, and the shaft 17 are assembled and not disassembled with one another.

As shown in FIGS. 6C and 7 the two stop grooves 17A to which the fittings 19 are fastened are provided with an interval therebetween a little narrower than the interval between the right and left side wall portions of the head support body 15. Therefore, the shaft 17 can be slid horizontally while the fittings 19 are fastened. Further, the left stop groove 17A is set at a position, where a right end of the shaft 17 does not fall out from the right bearing hole 16D of the lock or inner frame 16 and a tip end thereof somewhat enters the bearing hole 16D, in the case where the shaft 17 is slid farthest to the left. Further, the right stop groove 17A is set at a position, where both the right and left ends of the shaft are projected from both side surfaces of the lock frame 16 by a predetermined width, in the case where the shaft 17 is slid farthest to the right.

The springs 14 are set such that both ends thereof are fit into convex portions (now shown) respectively formed in the lock frame 16 and the head support body 15. The springs 14 bias the rear surface of the lock frame 16 and the head adhesion surface of the head support body 15 in a direction in which they repel each other. Incidentally, the projected portion 15B of the head support body 15, which enters the notch 16C of the lock frame 16, serves as a stopper, as a result of which it is limited such that the rear surface of the lock frame 16 and the head adhesion surface of the head support body 15 are not kept away from each other with an interval equal to or more than a constant interval. Thus, when the lock frame 16 is removed from the outer frame 18, biasing positions of the springs 14 are limited so as not to be separated from each other with the constant interval or more so that the springs 14 do not come off.

As shown in FIG. 3 and FIGS. 4A to 4C, the lock frame 16, with which the head support body 15 and the spring 14 are assembled as described above, is held such that the right end of the shaft 17 is borne in the bearing hole 18C in the right side wall of the outer frame 18 while the left end of the shaft 17 is borne in the U-groove 18B in the left side wall of the outer frame 18 in a state in which the shaft 17 is slid to the right side.

Further, as shown in FIG. 1, the shaft 17 borne in the U-groove 18B of the left side wall portion 18L is limited in terms of the slide in a horizontal direction and the movement to the guide inlet side of the U-groove 18B by means of the fixture 6 as a fixing means that retains the left end portion of the shaft 17, and is fixed at the position. The fixture 6 is fixed to a main body case frame or the like by, for example, a screw 6*a* at a position where attachment and detachment can be performed easily when a lid 1A of the main body case is opened.

In order that the lock frame 16, with which the thermal head 13, the springs 14, and the head support body 15 are assembled, is removed from the printing mechanism 10 assembled as described above, first, the platen roller 12 is removed by moving the carrying handle 16*b* of the lock frame 16, and thereafter, the fixture 6 is removed by loosening the screw 6A (FIG. 1). Then, the shaft 17 is made slidable. Therefore, the shaft 17 is slid leftward as shown in FIG. 4A and FIG. 5.

When the shaft 17 is slid leftward, the right end of the shaft 17 falls out from the bearing hole 18C of the outer frame 18. Thus, the lock frame 16 can be shifted forward as shown in FIG. 2B. By shifting the lock frame 16, the lock frame 16 can be removed from the outer frame 18 while being assembled with the thermal head 13, the springs 14, the head support body 15, and the shaft 17.

As described above, according to the label printer 1 and the printing mechanism 10 in this embodiment, only the thermal head 13 can be removed with ease without disassembling the whole peripheral components. Therefore, the shortening of time for exchange work and the reduction in maintenance cost can be attained in the event of, for example, failure of the thermal head 13.

Further, the thermal head 13 is removed together with the springs 14 and the lock frame 16 that supports one end of each of the springs 14. As a result, the force of the springs 14 does not interrupt removal work at all.

Moreover, the thermal head 13 can be removed while the attachment state of the springs 14 is held. Thus, when being set to a fixing jig for a test to perform a printing test, the removed thermal head 13 is made settable to the fixing jig together with the lock frame 16 such that the springs 14, which are removed together with the thermal head 13, impart the pressing force to a printing surface. Thus, it is not required that a newly pressing force is imparted to the thermal head 13, and the printing test can be performed by utilizing the pressing force of the removed springs 14. Further, since the thermal head 13 is removed while the attachment state of the springs 14 is held at the time of usage, a test for printing failure due to the springs 14 can also be performed.

Note that the present invention is not limited to the above-mentioned embodiment, and various changes can be made.

In the embodiment, for example, the lock frame 16, which also has a lock function of the platen roller 12, is shown as an example of the first frame detachably attachable together with the thermal head. However, the first frame may be or may not be provided with the lock function.

Figure 8:
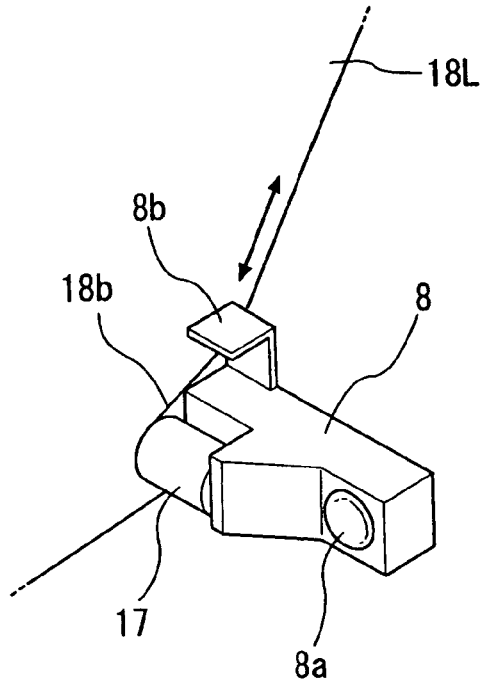
FIG. 8 is a perspective view showing another example of a fixture for fixing the shaft projected from the left side surface of the outer frame.

Further, various changes can be made as to the shape and fixing way of the fixture for fixing the shaft 17 projected from the U-groove 18B of the outer frame 18. For example, as shown in FIG. 8 which shows another example of the fixture, there may be adopted a fixture 8 capable of fixing and releasing the shaft 17 with one touch. The fixture 8 is rotatably attached to a main body frame (not shown) or the like by a fixing pin 8A. A carrying handle 8B is vertically moved and rotated, thereby fixing and releasing the shaft 17.

Further, the structure in which the first frame (lock frame 16) is made detachably attachable with respect to the second frame (outer frame 18) is not limited to the structure in which attachment and detachment can be performed by sliding the shaft 17. A structure, in which both the ends of the shaft 17 are retained by the fixture 6, 8 in FIG. 1 or 8, may be adopted. Alternatively, there may be adopted a structure in which attachment and detachment are performed without using the shaft in the case where the first frame is not additionally provided with the lock function.

As described above, according to the present invention, the thermal head portion is made easily exchangeable. As a result, the shortening of time for the maintenance work and the reduction in cost can be attained in the event of, for example, the failure of the thermal head.

Further, the biasing means that generates the pressing force between the thermal head and the platen roller is removed together with the thermal head. Thus, when being set to the fixing jig for a test to perform the printing test, the removed thermal head can be set to the fixing jig together with the first frame such that the biasing means, which is removed together with the thermal head, imparts the pressing force to the printing surface. As a result, simplification of the printing test can be attained.

Furthermore, the thermal head, the biasing means, and the first frame are detached and attached while being assembled with one another. Therefore, the test can be made also in point of the printing failure due to the biasing means such as the printing failure that arises from abnormality of the attachment state of the biasing means.

What is claimed is:

1. A thermal printer in which printing is performed while paper is sandwiched between a thermal head having a heating element and a platen roller, comprising:

a first frame that movably holds a head support body on which is mounted the thermal head;

biasing means disposed between the head support body and the first frame for applying a pressing force between the thermal head and the platen roller; and a second frame that holds the first frame and the platen roller;

wherein the thermal head, the head support body, and the biasing means are detachably attachable to the second frame in the state of being assembled with the first frame;

bearing holes through which a shaft is passed are provided in both side walls of each of the head support body and the first frame;

the second frame is provided with a bearing hole, through which the support shaft is passed, in one side wall thereof, and a bearing groove that bears the support shaft in the other side wall thereof;

the support shaft is passed through the bearing holes of the first frame and second frame and the bearing holes of the head support body and is borne in the bearing groove of the second frame, whereby the head support body is held by the first frame in a rotatable state about the support shaft, and also, the first frame is held by the second frame in a rotatable state about the support shaft;

the support shaft is fastened with a fitting that retains the support shaft to prevent it from falling out from the head support body and the first frame in a state in which the support shaft can be slid in an axial direction within a limited movable range;

the thermal printer is provided with fixing means which is brought into contact with the support shaft in a state in which the support shaft is passed through the bearing hole of the second frame to limit sliding of the support shaft in the movable range and which retains the support shaft to prevent it from coming off from the bearing groove of the second frame; and the retainment of the fixing means is released to permit the support shaft to slide in the movable range, whereby the support shaft is made to fall out from the bearing hole of the second frame while the support shaft is passed through the first frame and the head support body to make the first frame removable from the second frame.

2. A thermal printer according to claim 1; wherein the fixing means is comprised of a fixture that enables retainment and release of the support shaft through one operation or attachment and detachment of a screw.

* * * * *